US008308009B2

(12) United States Patent
Joordens

(10) Patent No.: US 8,308,009 B2
(45) Date of Patent: Nov. 13, 2012

(54) PEDAL BIN

(75) Inventor: Josephus Arnoldus Joordens, Eersel (NL)

(73) Assignee: Brabantia Nederlands B.V., Waalre (NL)

( * ) Notice: Subject to any disclaimer, the term of this patent is extended or adjusted under 35 U.S.C. 154(b) by 891 days.

(21) Appl. No.: 11/631,071

(22) PCT Filed: Jul. 1, 2005

(86) PCT No.: PCT/NL2005/000468

§ 371 (c)(1),
(2), (4) Date: Jun. 9, 2009

(87) PCT Pub. No.: WO2006/004403

PCT Pub. Date: Jan. 12, 2006

(65) Prior Publication Data

US 2009/0236340 A1 Sep. 24, 2009

(30) Foreign Application Priority Data

Jul. 1, 2004 (NL) ..... 1026542

(51) Int. Cl.
*B65D 43/26* (2006.01)

(52) U.S. Cl. ..... 220/264; 220/263; 220/262; 220/260; 220/908

(58) Field of Classification Search ..... 220/264, 220/263, 262, 260, 315, 324, 326, 810, 827, 220/830, 833; D34/8, 9; 16/286, 308, 278, 16/285

See application file for complete search history.

(56) References Cited

U.S. PATENT DOCUMENTS

| | | | | | |
|---|---|---|---|---|---|
| 2,216,279 | A * | 10/1940 | Packer | 220/263 |
| 2,475,125 | A * | 7/1949 | Brownell | 220/263 |
| 2,563,456 | A * | 8/1951 | Brownell | 220/263 |
| 2,910,206 | A * | 10/1959 | Hodgson | 220/23.87 |
| 4,785,964 | A * | 11/1988 | Miller et al. | 220/263 |
| 4,865,214 | A * | 9/1989 | Koda et al. | 220/263 |
| 4,953,740 | A * | 9/1990 | Koda | 220/263 |
| 5,187,890 | A * | 2/1993 | Johnston | 43/4 |
| 5,249,693 | A * | 10/1993 | Gillispie et al. | 220/263 |
| 6,010,024 | A * | 1/2000 | Wang | 220/23.87 |
| 6,588,624 | B1 * | 7/2003 | Connors et al. | 220/827 |
| 6,857,538 | B2 * | 2/2005 | Lin | 220/830 |
| 6,920,994 | B2 * | 7/2005 | Lin | 220/264 |

(Continued)

FOREIGN PATENT DOCUMENTS

DE 7922551 U1 11/1979

(Continued)

*Primary Examiner* — Anthony Stashick
*Assistant Examiner* — Chetan Chandra
(74) *Attorney, Agent, or Firm* — The Webb Law Firm

(57) ABSTRACT

A pedal bin having a housing in which a waste container can be accommodated, a lid mounted at the top of the housing by a pivot pin, which lid has a lever that extends on the side of the pivot pin facing away from the lid and at this location has a sliding construction that allows a sliding movement between a relatively low position and a relatively high position in a plane transverse to the pivot pin, a movable pedal provided at the bottom of the housing as well as an operating member interacting with the sliding construction of the lid and the pedal for pivoting the lid, by depressing the pedal, between a closed position and a first open position defined by a first pivot angle with respect to the closed position, the sliding construction and the operating member being in the relatively low position and the operating member being subjected to tensile force.

7 Claims, 5 Drawing Sheets

U.S. PATENT DOCUMENTS

| | | | | |
|---|---|---|---|---|
| 7,108,148 | B2 * | 9/2006 | Lu | 220/263 |
| 2002/0092853 | A1 * | 7/2002 | Wang | 220/263 |
| 2003/0201268 | A1 * | 10/2003 | Lin | 220/263 |
| 2006/0000834 | A1 * | 1/2006 | Lin | 220/264 |
| 2006/0213910 | A1 * | 9/2006 | Yang et al. | 220/264 |
| 2007/0125782 | A1 * | 6/2007 | Wong et al. | 220/263 |

FOREIGN PATENT DOCUMENTS

| | | | |
|---|---|---|---|
| GB | 2065455 A | * | 7/1981 |
| GB | 2205730 A | * | 12/1988 |
| NL | 1005057 | * | 7/1998 |
| NL | 1005057 C2 | | 7/1998 |

* cited by examiner

PEDAL BIN

BACKGROUND OF THE INVENTION

1. Field of the Invention

The invention relates to a pedal bin comprising a housing in which a waste container can be accommodated, a lid mounted at the top of the housing by means of a pivot pin, which lid has lever means that extend on the side of the pivot pin facing away from the lid and at this location has a sliding construction that allows a sliding movement between a relatively low position and a relatively high position in a plane transverse to the pivot pin, a movable pedal provided at the bottom of the housing and an operating rod interacting with the sliding construction of the lid and the pedal for pivoting the lid, by means of depressing the pedal, between a closed position and a first open position defined by a first pivot angle with respect to the closed position, the sliding construction and the operating rod being in the relatively low position and the operating rod being subjected to tensile force.

2. Description of the Related Art

A pedal bin of this type is disclosed in NL-A 1 005 057. This known pedal bin has the disadvantage that the lid cannot easily be pivoted into a second position in which it is opened further.

SUMMARY OF THE INVENTION

The aim of the invention is therefore to provide a pedal bin that does not have these disadvantages. Said aim is achieved in that the lid can be pivoted further into a second open position defined by a second pivot angle with respect to the closed position by direct operation of the lid, for example, by hand, which second pivot angle is larger than the first pivot angle, and in that auxiliary means are provided for holding the sliding construction in the relatively high position when the lid moves into the second open position, it being possible to move the sliding construction and the operating member into the relatively low position overcoming the pretension when the pedal is depressed, and in that stop means are provided for defining the first open position and the second open position of the lid, which stop means comprise a stop member fixed to the lid as well as at least two operating member sections, such that in the relatively low position of the operating member the stop member is in contact with a first operating member section and in the relatively high position of the operating member the stop member is in contact with a second operating member section.

Because the pedal bin according to the invention has auxiliary means for holding the sliding construction up, the advantage is obtained that both the first open position and the second open position of the lid are clearly defined by separate stops.

The sliding construction can be made in various ways, for example using a carriage. According to a preferred embodiment the sliding construction comprises a lever with a slot, which slot has an end positioned relatively low and an end positioned relatively high, as well as a slider that can be slid in the slot and is joined to the pull rod. A simple embodiment is preferred in connection with reliability, durability and cost price. In a very simple embodiment the slider is formed by an end of the pull rod that is accommodated in the slot such that it can slide.

The auxiliary means can comprise a pretensioning member that engages on the sliding construction. For example, the pretensioning member can comprise a helical torsion spring that is located around the pivot pin.

If the centre of gravity of the lid is on the side of the lid facing away from the lever means when the lid is in the first open position, it is always ensured that when the lid is operated by the foot this always returns to the closed position under the influence of gravity. It is then not necessary to close the lid by hand.

Although a pull rod has been mentioned as an example of the operating member, an operating member that is flexible to bending but rigid to pulling, such as a wire line or chain or the like, can also be used.

BRIEF DESCRIPTION OF THE DRAWINGS

The invention will be explained in more detail with reference to the illustrative embodiment shown in the figures.

DETAILED DESCRIPTION OF THE INVENTION

Figure 1:
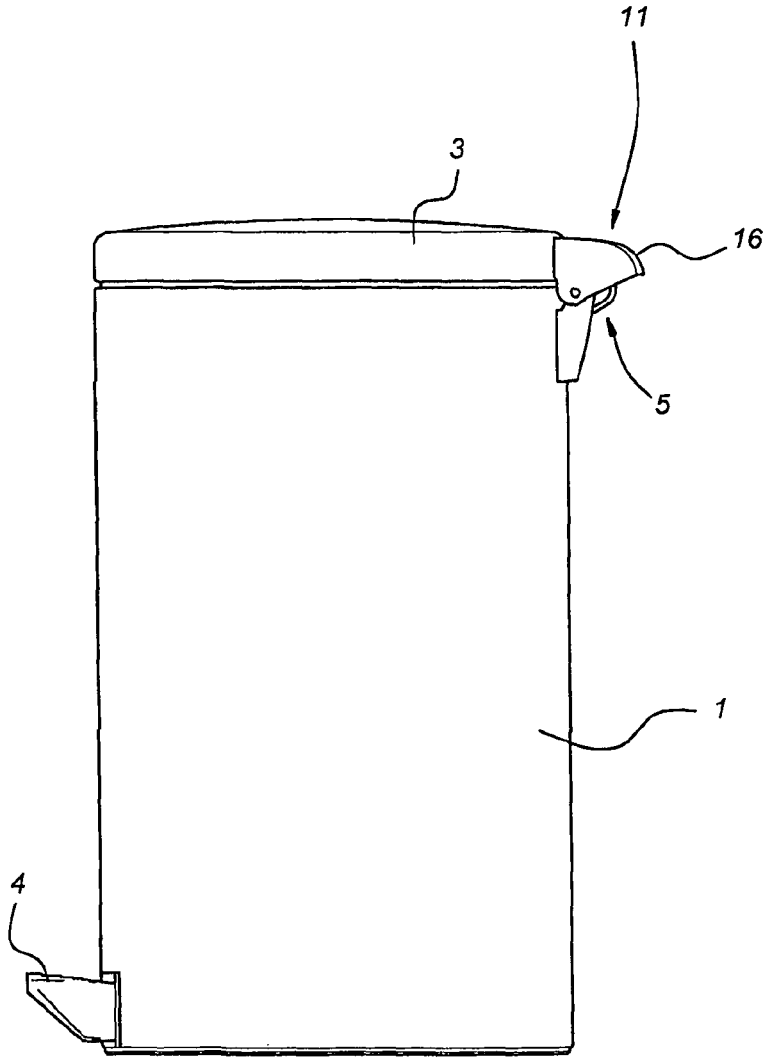
FIG. 1 shows a side view of a pedal bin according to the invention.
Figure 2:
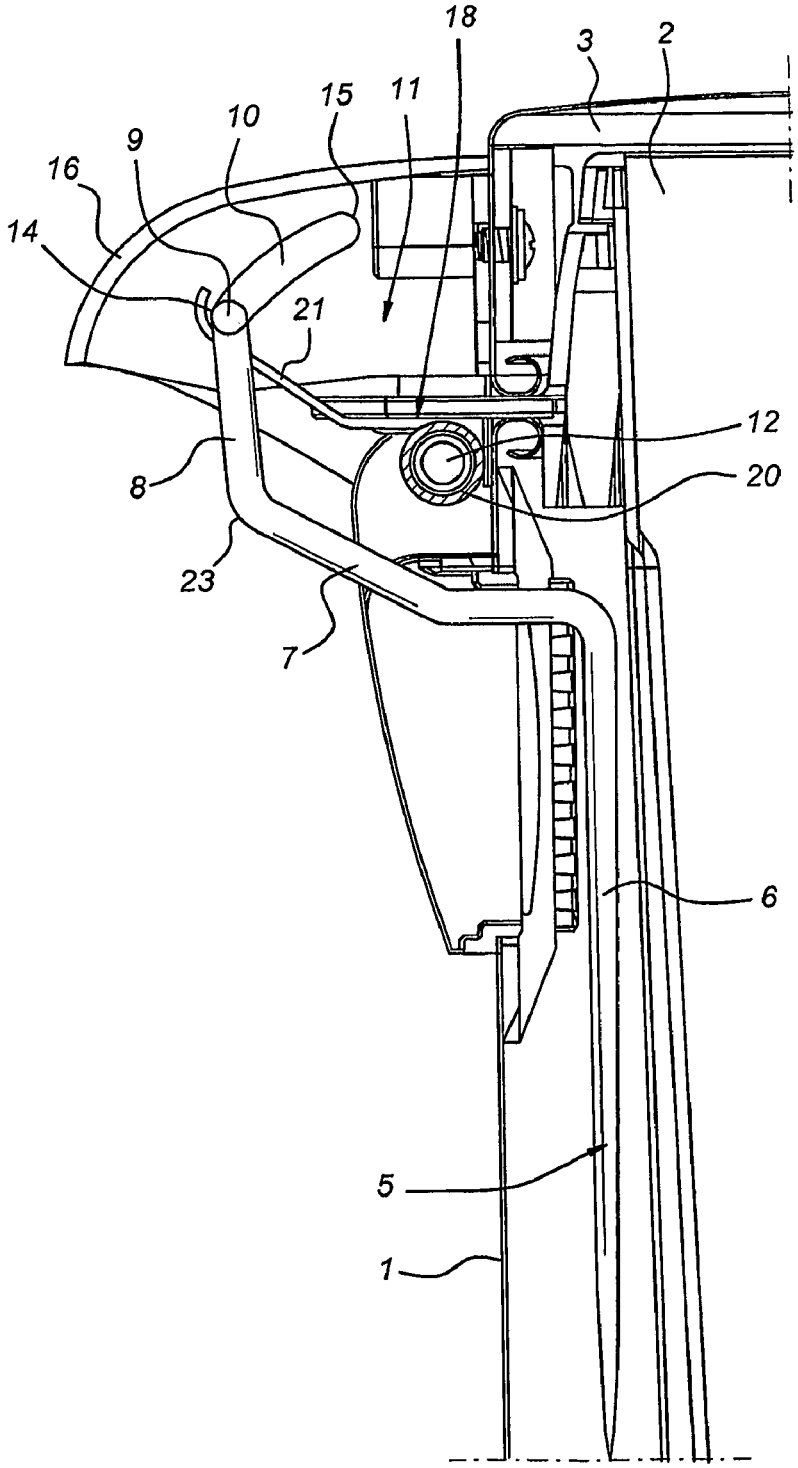
FIG. 2 shows a section through the region of the container where the lid hinge is located, with the lid in the closed position.
Figure 3:
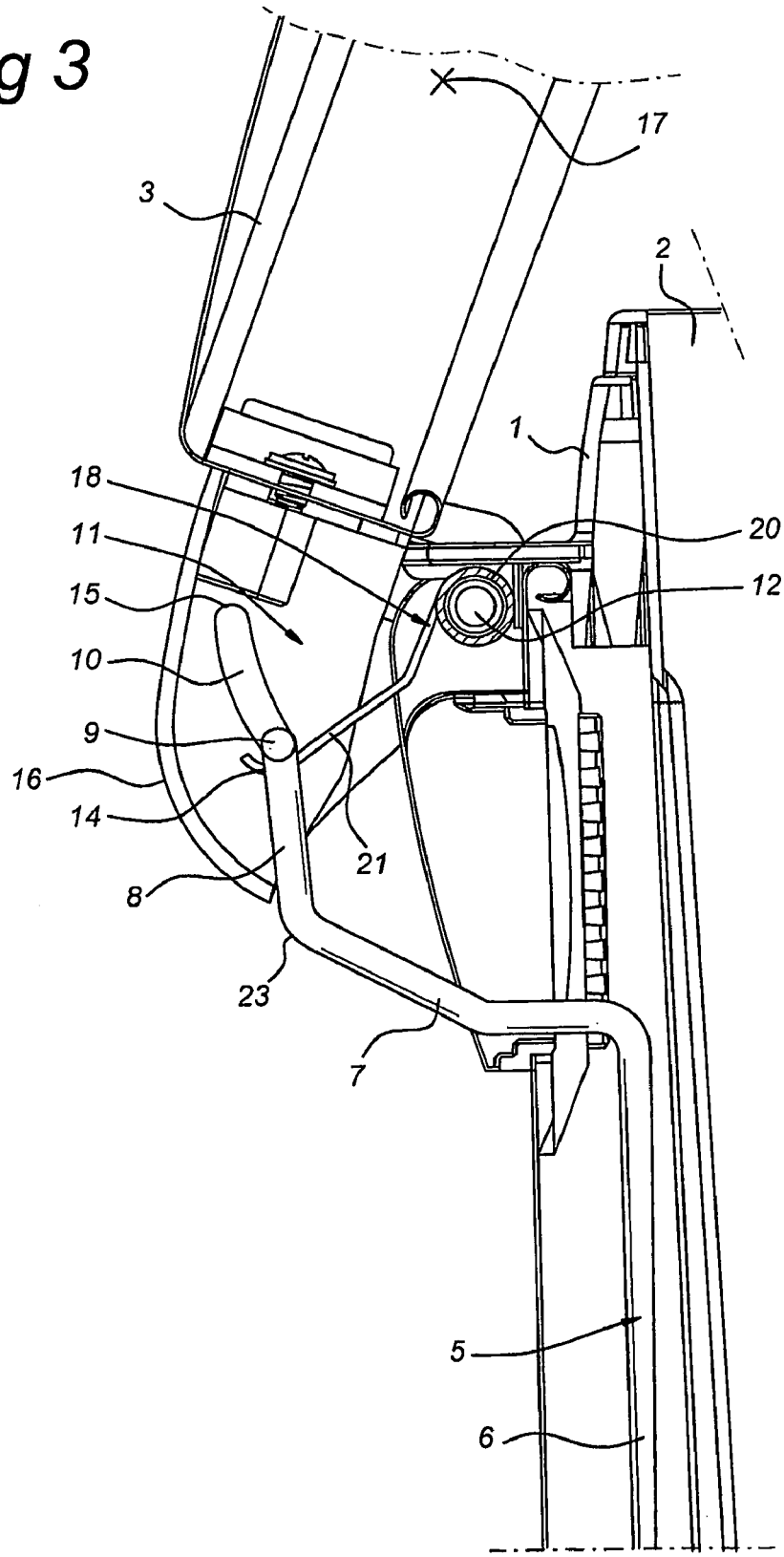
FIG. 3 shows a section corresponding to that in FIG. 2, with the lid in the first open position.
Figure 4:
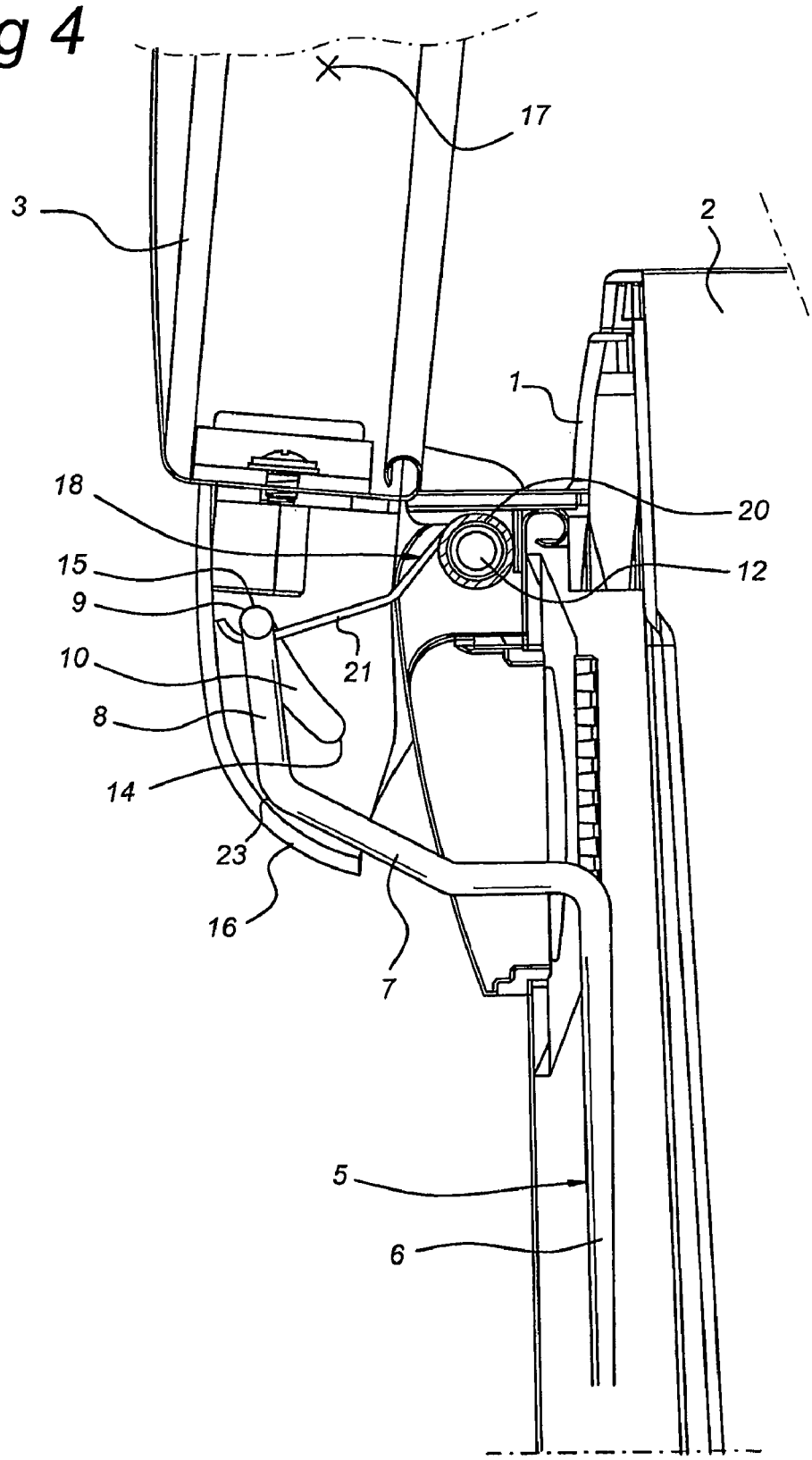
FIG. 4 shows a section corresponding to that in FIG. 2, with the lid in the second open position.
Figure 5:
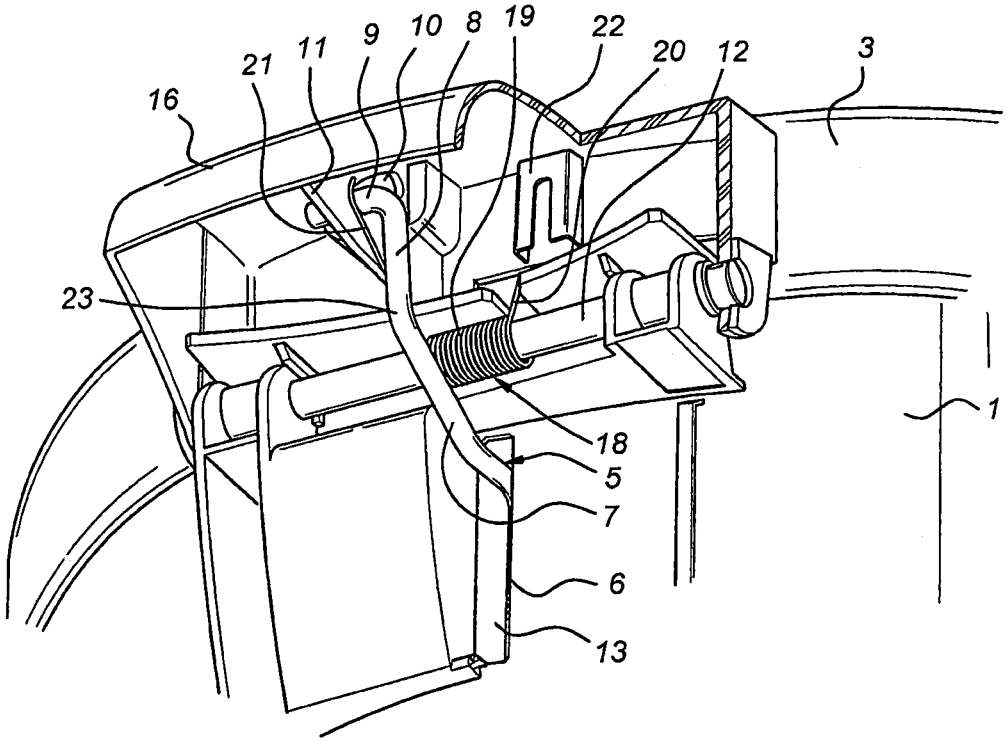
FIG. 5 shows a partial bottom view, in perspective, of the region of the pedal bin where the lid hinge is located.

In a known manner the pedal bin shown in FIG. 1 has a housing 1 in which there is a container 2 (see FIGS. 2-4). The container is closed off at the top by the hinged lid 3. The lid can be opened by means of the pedal 4, as will be explained in more detail with reference to FIGS. 2-4.

The pedal 4 is connected in a known manner, which is not shown in more detail, to the pull rod indicated in its entirety by 5. This pull rod has a vertical main section 6 to which the end section 8, which likewise runs virtually vertically, is joined via the laterally bent section 7. This end section 8 merges into a bent end 9 that has been inserted in the somewhat curved slot 10 in the lever 11. This lever 11 is fixed to the lid 3, specifically on that side of the hinge pin 12 by means of which the lid 3 is attached to the container 1 such that it can pivot, facing away from said lid 3.

The major section of the pull rod 5, in particular the vertical main section 6, runs inside the container 1. The lateral section 7 protrudes outwards via the slot 13.

In the rest position shown in FIG. 2, in which the lid 3 is closed on the container 1, the end 9 of the pull rod 5 is in the relatively low position in contact with the end wall 14 of the slot 10. When the pedal 4 is depressed, the pull rod 5 moves downwards, the lever 11, and thus the lid 3, being pivoted about the pivot pin 10 by the end 9 of said pull rod 5 into the position shown in FIG. 3. During this operation the end 9 remains pressed against the end wall 14 of the slot 10.

The lever 11 has a stop member 16 that, as shown in FIG. 3, comes into contact with the vertical end section 8 of the pull rod 5 during this movement. As a result the first open position of the lid 3, which is reached by operation of the pedal 4, is well defined. Preferably the centre of gravity 17 of the lid 3 in the position shown in FIG. 3 is still on the side of the container 1 with respect to the pivot pin 12 such that the lid 3 pivots back into the closed position under the influence of gravity when the pedal 4 is released.

The lid 3 can also be opened from the closed position shown in FIG. 2 without operating the pedal 4. The lid 3 can be raised by hand, with the intention of obtaining a second open position of the lid 3 that is further open. In this second open position the container 2 can, for example, be removed from the housing 1 or replaced in the housing 1 after the container 2 has been emptied. However, without a further facility the pull rod 5 would drop under the influence of gravity during said manual opening because the end wall 14 of the slot 10 moves downwards. The stop member 16 would thus then also come into contact with the end section 8 of the pull rod 5 again, as a result of which the lid 3 would not be able to be pivoted further than the first open position shown in FIG. 3.

According to the invention a torsion spring indicated in its entirety by 18 is now provided. The helically wound section 19 thereof is arranged around the rotary pin 12. The one end 20 of the torsion spring bears inside the chamber 22 of the hinge section that is joined to the lid 3; the other end 21 is hooked under the end 9 of the pull rod 5. The torsion spring 18 is pretensioned in such a way that a pretensioning force oriented upwards is exerted on the end 9.

As a consequence of this pretensioning force the pull rod 5 remains in the relatively high position even when the lid 3 is pivoted by hand into the open position in FIG. 4. As a result the end 9 comes into contact with the relatively high end wall 14 of the slot 10. As a result the stop member 16 is able to move past the end section 8 and the lid 3 is able to reach the second open position according to FIG. 4 unimpeded. In this second open position the stop member 16 is in contact with the laterally bent section 7 and/or with the curved section 23 that is located between the end section 8 running vertically and the section 7 bent laterally.

The advantage of the use of a pull member such as a pull rod or pull wire is that more direct operation of the lid is possible by this means than with a push rod. This advantage comes to the forefront especially in the case of larger containers with a large lid. A pull rod provides a relatively rigid transmission. A push rod has the disadvantage that the rigidity thereof is less as a consequence of kinking phenomena.

The invention claimed is:

1. A pedal waste bin comprising:

a housing in which a waste container can be accommodated, a lid mounted at the top of the housing by means of a pivot pin, which lid has a lever mechanism that extends on the side of the pivot pin facing away from the lid and at this location has a sliding construction, a movable pedal provided at the bottom of the housing, and an operating member interacting with the sliding construction of the lid and the pedal for pivoting the lid, by means of depressing the pedal, between a closed position and a first open position defined by a first pivot angle with respect to the closed position, the sliding construction and an end portion of the operating member allowing a sliding movement between a relatively low position and a relatively high position in a plane transverse to the pivot pin, the sliding construction and the operating member being in the relatively low position and the operating member being subjected to tensile force in the first open position, wherein the lid can be pivoted from the closed position into a second open position defined by a second pivot angle with respect to the closed position by direct operation of the lid by hand, the second pivot angle being larger than the first pivot angle, and the sliding construction and the operating member being in the relatively high position in the second open position, a pretensioning mechanism is provided for holding the sliding construction and said end portion of the operating member under pretension in the relatively high position, it being possible to move the sliding construction and said end portion of the operating member into the relatively low position overcoming the pretension when the pedal is depressed, the pretensioning mechanism comprising a spring provided at the lever mechanism and directly acting on said end portion of the operating member so as to exert an upwards force, and a stop mechanism is provided for defining the first open position and the second open position of the lid both as respective end positions when opening the lid from the closed position, the stop mechanism comprising at least two operating member sections and a stop member, such that the stop member is fixed to the lid and that the stop member is in contact with a first operating member section in the relatively low position of the operating member and the first open position of the lid, and the stop member is in contact with a second operating member section in the relatively high position of the operating member and the second open position of the lid.

2. The pedal bin according to claim 1, wherein the sliding construction comprises a lever with a slot, which slot has an end positioned relatively low and an end positioned relatively high, as well as a slider that can be slid in the slot and is joined to the operating member.

3. The pedal bin according to claim 2, wherein the operating member has an end that is accommodated in the slot such that it can slide.

4. The pedal bin according to claim 1, wherein the pretensioning member comprises a helical torsion spring having a helically wound section arranged around the pivot pin such that the pivot pin passes through the helically wound section.

5. The pedal bin according to claim 1, wherein the centre of gravity of the lid is on the side of the lid facing away from the lever means when the lid is in the first open position.

6. The pedal bin according to claim 1, wherein the centre of gravity of the lid is on the side of the lid facing the lever means when the lid is in the second open position.

7. The pedal bin according to claim 1, wherein the operating member comprises a pull rod.

* * * * *